US009704326B2

(12) United States Patent
Kinoshita et al.

(10) Patent No.: US 9,704,326 B2
(45) Date of Patent: Jul. 11, 2017

(54) PAPER SHEET HANDLING APPARATUS

(71) Applicant: Hitachi-Omron Terminal Solutions, Corp., Tokyo (JP)

(72) Inventors: Yasushi Kinoshita, Tokyo (JP); Eisuke Shiomi, Tokyo (JP); Masanori Terao, Tokyo (JP); Junji Fujita, Tokyo (JP)

(73) Assignee: HITACHI-OMRON TERMINAL SOLUTIONS, CORP., Tokyo (JP)

( * ) Notice: Subject to any disclaimer, the term of this patent is extended or adjusted under 35 U.S.C. 154(b) by 0 days.

(21) Appl. No.: 15/141,212

(22) Filed: Apr. 28, 2016

(65) Prior Publication Data

US 2016/0358402 A1 Dec. 8, 2016

(30) Foreign Application Priority Data

Jun. 3, 2015 (JP) ..... 2015-113525

(51) Int. Cl.
*G07F 19/00* (2006.01)
*G07D 11/00* (2006.01)
*G07D 7/121* (2016.01)

(52) U.S. Cl.
CPC ..... *G07D 11/0036* (2013.01); *G07D 7/121* (2013.01); *G07D 11/0066* (2013.01)

(58) Field of Classification Search
CPC ..... B65H 2220/01; B65H 2511/51; B65H 2511/515; B65H 2405/32; B65H 2220/09; G07D 7/121; G07D 11/0066; G07D 7/122; G07D 11/0036; G07D 11/0084; G07D 7/004; G07D 7/128; G07D 7/164
USPC ..... 235/379, 375
See application file for complete search history.

(56) References Cited

U.S. PATENT DOCUMENTS 4,367,945 A * 1/1983 Abe ..... G03B 27/526 355/51
4,759,205 A * 7/1988 Kuwano ..... B21B 37/68 72/232
5,030,830 A * 7/1991 Okada ..... G01T 1/1644 250/361 R
5,386,122 A * 1/1995 Yoshida ..... G01T 1/2018 250/368
5,574,790 A * 11/1996 Liang ..... G07D 7/122 283/89

(Continued)

FOREIGN PATENT DOCUMENTS

EP 2 557 769 A1 2/2013
JP 63-44125 U 3/1988

(Continued)

*Primary Examiner* — Thien M Le
(74) *Attorney, Agent, or Firm* — Foley & Lardner LLP

(57) ABSTRACT

A paper sheet handling apparatus capable of effectively preventing a photodetector from malfunctioning due to external light is provided. The present invention is a paper sheet handling apparatus including a paper sheet handling port, a projector for emitting light within the paper sheet handling port, a photodetector for receiving the light emitted from the projector, and a light-shielding body that is formed along an optical path from the projector towards the photodetector and shields the photodetector against external light; wherein a projector-side end of the light-shielding body is formed to be retracted from an incident direction of the external light towards the photodetector.

11 Claims, 16 Drawing Sheets

(56) References Cited

U.S. PATENT DOCUMENTS

| | | | | |
|---|---|---|---|---|
| 6,172,745 | B1 * | 1/2001 | Voser | G01D 5/34723 356/445 |
| 7,903,134 | B2 * | 3/2011 | Itabashi | H04N 1/0473 347/235 |
| 8,684,156 | B1 | 4/2014 | Chang | |
| 2002/0195571 | A1 | 12/2002 | Kamijo et al. | |
| 2013/0010377 | A1 * | 1/2013 | Okuyama | G02B 27/0018 359/819 |
| 2015/0009545 | A1 * | 1/2015 | Hozono | G02B 7/02 358/483 |

FOREIGN PATENT DOCUMENTS

| | | | |
|---|---|---|---|
| JP | 05-319683 | A | 12/1993 |
| WO | WO 2014/130644 | A1 | 8/2014 |

* cited by examiner

PAPER SHEET HANDLING APPARATUS

TECHNICAL FIELD

This invention relates to a paper sheet handling apparatus suited for handling of paper sheets such as bills.

BACKGROUND ART

A paper sheet handling apparatus that handles paper sheets (such as bills) is mounted in, for example, an automatic teller machine (ATM) installed at a financial institute or the like and includes a money deposit/Withdrawal port for a user to deposit or withdraw paper sheets and a conveyance unit for conveying the paper sheets to and from a paper sheet storage container in a safe. The money deposit/withdrawal port of the paper sheet handling apparatus is provided with a photodetector that detects insertion/removal of paper sheets and the user's fingers; and the paper sheet handling apparatus can handle the paper sheets for the purpose of money deposit and withdrawal by controlling the operation to open and close a shutter provided at the money deposit/withdrawal port on the basis of detected information from this photodetector.

Regarding automatic teller machines, some are of an outside wall type which is embedded on a wall of a building, and some are installed inside shops; and external light (particularly, sunlight) may sometimes affect the money deposit/withdrawal port of the paper sheet handling apparatus. Specifically speaking, when the shutter of the money deposit/withdrawal port is left opened and the external light reaches a deepest part of the money deposit/withdrawal port, the photodetector may mistakenly detect the external light and malfunction and the paper sheet handling apparatus may abruptly close the shutter.

Thus, as a means for preventing false detection of the external light, there is a know example in which a light-shielding barrel is connected to a photodetector to enable the photodetector to detect the light emitted from a projector via the light-shielding barrel, while protecting the photodetector with the light-shielding barrel against the external light (for example, PTL 1 and PTL 2).

CITATION LIST

Patent Literature

[PTL 1] Japanese Utility Model Application Laid-Open (Kokai) Publication No. 1988-44125

[PTL 2] Japanese Patent Application Laid-Open (Kokai) Publication No. 1993-319683

SUMMARY OF INVENTION

Problems to be Solved by the Invention

However, since the means of the conventional paper sheet handling apparatus for shielding the photodetector against the external light has been insufficient, there is a possibility that the photodetector may malfunction due to the external light. It is an object of the present application to provide a paper sheet handling apparatus capable of effectively preventing the photodetector from malfunctioning due to the external light.

Means for Solving the Problems

A first aspect of a paper sheet handling apparatus includes: a paper sheet handling port; a projector for emitting light within the paper sheet handling port; a photodetector for receiving the light emitted from the projector; and a light-shielding body that is formed along an optical path from the projector towards the photodetector and shields the photodetector against external light; wherein a projector-side end of the light-shielding body is formed to be retracted from an incident direction of the external light towards the photodetector.

A second aspect of the paper sheet handling apparatus includes: a paper sheet handling port; a projector for emitting light within the paper sheet handling port; a photodetector for receiving the light emitted from the projector; and a light-shielding body that is formed along an optical path from the projector towards the photodetector and shields the photodetector against external light; wherein grooves for reflecting the external light are formed in an inside surface of the light-shielding body.

A third aspect of the paper sheet handling apparatus includes: a paper sheet handling port; a projector for emitting light within the paper sheet handling port; a photodetector for receiving the light emitted from the projector; and a light-shielding body that is formed along an optical path from the projector towards the photodetector and shields the photodetector against external light; wherein a side face of the photodetector is covered with a light-shielding member.

Advantageous Effects of Invention

A paper sheet handling apparatus capable of effectively preventing a photodetector from malfunctioning due to the external light is provided.

MODE FOR CARRYING OUT THE INVENTION

Figure 1:
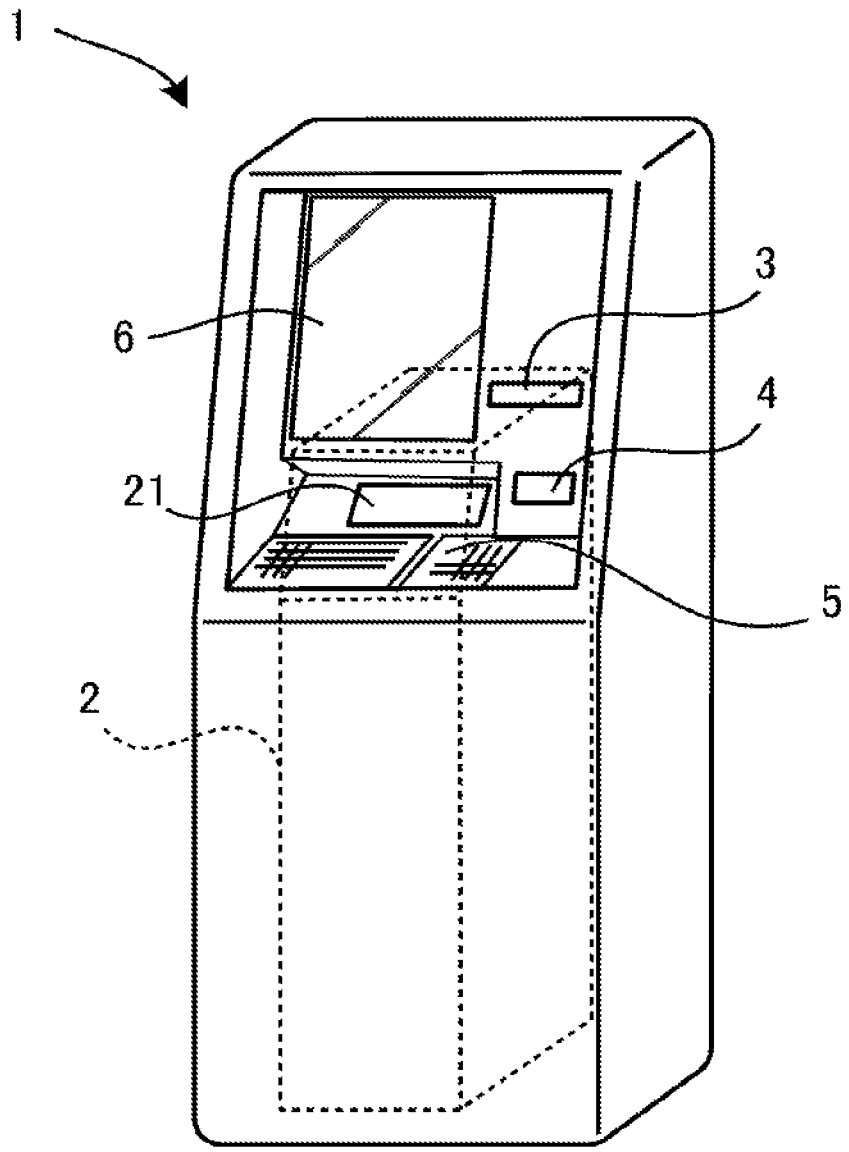
FIG. 1 is a full perspective view of an automatic teller machine equipped with a paper sheet handling apparatus according to an embodiment.

Next, an embodiment will be explained. A paper sheet handling apparatus according to the embodiment is mounted in, for example, an automatic teller machine for cash (bills: paper sheets). Referring to FIG. 1, an automatic teller machine 1 includes a paper sheet handling apparatus 2, a passbook handling device 3, a card handling device 4, an operation device 5, and a display device 6. The paper sheet handling apparatus 2 has a money deposit/withdrawal port 21 on a front face of the automatic teller machine 1 so as to enable handling of paper sheets such as bills and cash vouchers. Then, the paper sheets are automatically conveyed between the money deposit/withdrawal port 21 and a paper sheet storage unit (storage containers 26*a* to 26*e* illustrated in FIG. 2) in a safe.

The passbook handling device 3 executes processing for taking in a passbook inserted into a passbook insertion port, printing information such as a deposit balance, and then returning the passbook to the passbook insertion port to return it to the user. The card handling device 4 handles magnetic stripe cards and IC cards. The operation device 5 enables operations such as inputting a passcode and inputting necessary information for transactions. The display device 6 is equipped with a touch panel to display transaction details and operation guides for the user.

The automatic teller machine 1 provides various services such as deposit, withdrawal, transfer, and transfer between accounts of the same account holder at the same financial institute. A money deposit/withdrawal transaction generally proceeds in the following order. The display device 6 displays a menu of various services. Once the user selects either deposit or withdrawal, a message requesting presentation of a passbook and a card is displayed. The passbook handling device 3 and the card handling device 4 prompt insertion of the passbook and the card, thereby starting deposit/withdrawal operation. In a case of deposit, the money deposit/withdrawal port is opened to wait for paper sheets to be inserted. As the user inserts paper sheets into the money deposit/withdrawal port, the inserted paper sheets are detected and the money deposit/withdrawal port is closed and the display device 6 displays a message to check the transaction details. After the user performs check operation, the paper sheets are stored in the safe. Also in a case of withdrawal, once the user inputs the transaction details, paper sheets are taken out of the safe and the money deposit/withdrawal port is opened so that the paper sheets can be taken out. After removal of the paper sheets from the money deposit/withdrawal port is detected, the money deposit/withdrawal port is automatically closed. When a series of operation of the paper sheet handling apparatus 2 is completed, a paper sheet handling result is displayed, the handling result is printed on the passbook, and the passbook and the card are returned.

Figure 2:
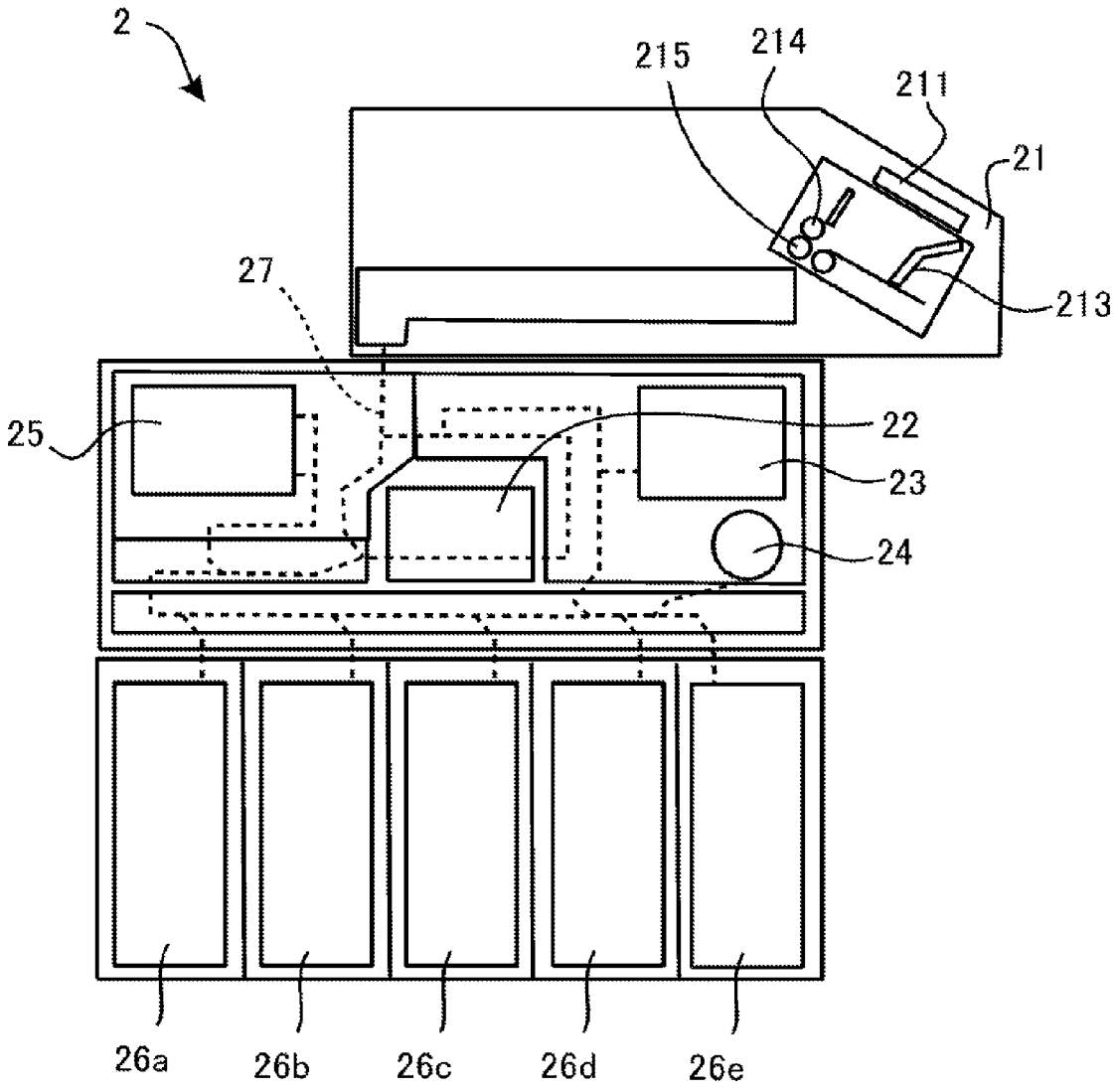
FIG. 2 is a diagram of the paper sheet handling apparatus, as seen from its side, for explaining an internal configuration of the paper sheet handling apparatus.

Referring to FIG. 2, the paper sheet handling apparatus 2 includes the money deposit/withdrawal port 21, a discrimination device 22, a temporary storage container 23, a temporary return storage container 24, a rejected paper sheet container 25, storage containers 26*a* to 26*e*, and a conveying path 27. The money deposit/withdrawal port 21 is a structure having a recess space for delivering/receiving paper sheets to/from the user as described earlier. The money deposit/withdrawal port 21 is provided with a shutter 21 as a shutter for opening and closing an end of the recess space, a pushing plate 213 for pushing the paper sheets to a separation unit, a separation roller 214 for separating the paper sheets, and a feed roller 215 for conveying the paper sheets.

The discrimination device 22 has an image sensor for discriminating the denominations and authenticity of bills, uses the image sensor to read images of the paper sheets conveyed to the image sensor, and discriminates the types and authenticity of the paper sheets on the basis of the images. The temporary storage container 23 temporarily stores the paper sheets which have passed the discrimination by the discrimination device 22. The temporary storage container 23 accumulates the bills conveyed from the conveying path 27 and feeds the paper sheets by separating the accumulated paper sheets one by one and delivering them to the conveying path 27.

The temporary return storage container 24 temporarily stores the paper sheets which failed to be discriminated by the discrimination device 22 until they are returned. The temporary return storage container 24 accumulates and feeds the paper sheets in the same manner as the temporary storage container 23 does. The rejected paper sheet container 25 stores the paper sheets whose types could not be identified by the discrimination device 22, and paper sheets which have been identified as counterfeit bills or special cash vouchers. The storage containers 26*a* to 26*e* store the paper sheets on the basis of denominations. When storing the paper sheets, the storage containers 26*a* to 26*e* accumulate and store the paper sheets received from the conveying path 27. Furthermore, upon discharge of the paper sheets, the storage containers 26*a* to 26*e* separate the accumulated paper sheets one by one and feed them to the conveying path 27. The storage containers 26*a* to 26*e* are carried out of the paper sheet handling apparatus 2 and are utilized for the operation to, for example, collect or replenish the paper sheets. It is possible to apply one of the storage containers 26*a* to 26*e* to collect counterfeit bills or store paper sheets which users forgot to take.

The conveying path 27 is composed of conveyance rollers, conveyance belts, and guide plates in order to convey the paper sheets and a gate for switching a delivery direction exists at branch points. The conveyance rollers and the conveyance belts are driven by a motor and are configured so that they can convey the paper sheets in an arbitrary direction at an arbitrary speed; and a sensor exists in the middle of the conveying path 27 so that a paper sheet conveyance status can be monitored and jamming of the paper sheets can be detected.

The discrimination device 22, the temporary storage container 23, the temporary return storage container 24, the rejected paper sheet container 25, and the storage containers 26*a* to 26*e* are placed in a safe which is not shown in the drawing. The safe is composed of antitheft thick metal plates, has a shutter with a lock, and is configured so that the safe is opened to enable some of the storage containers 26*a* to 26*e* or the paper sheet handling apparatus 2 to be pulled out when operating the storage containers 26*a* to 26*e* or maintaining and managing the paper sheet handling apparatus 2.

Figure 3:
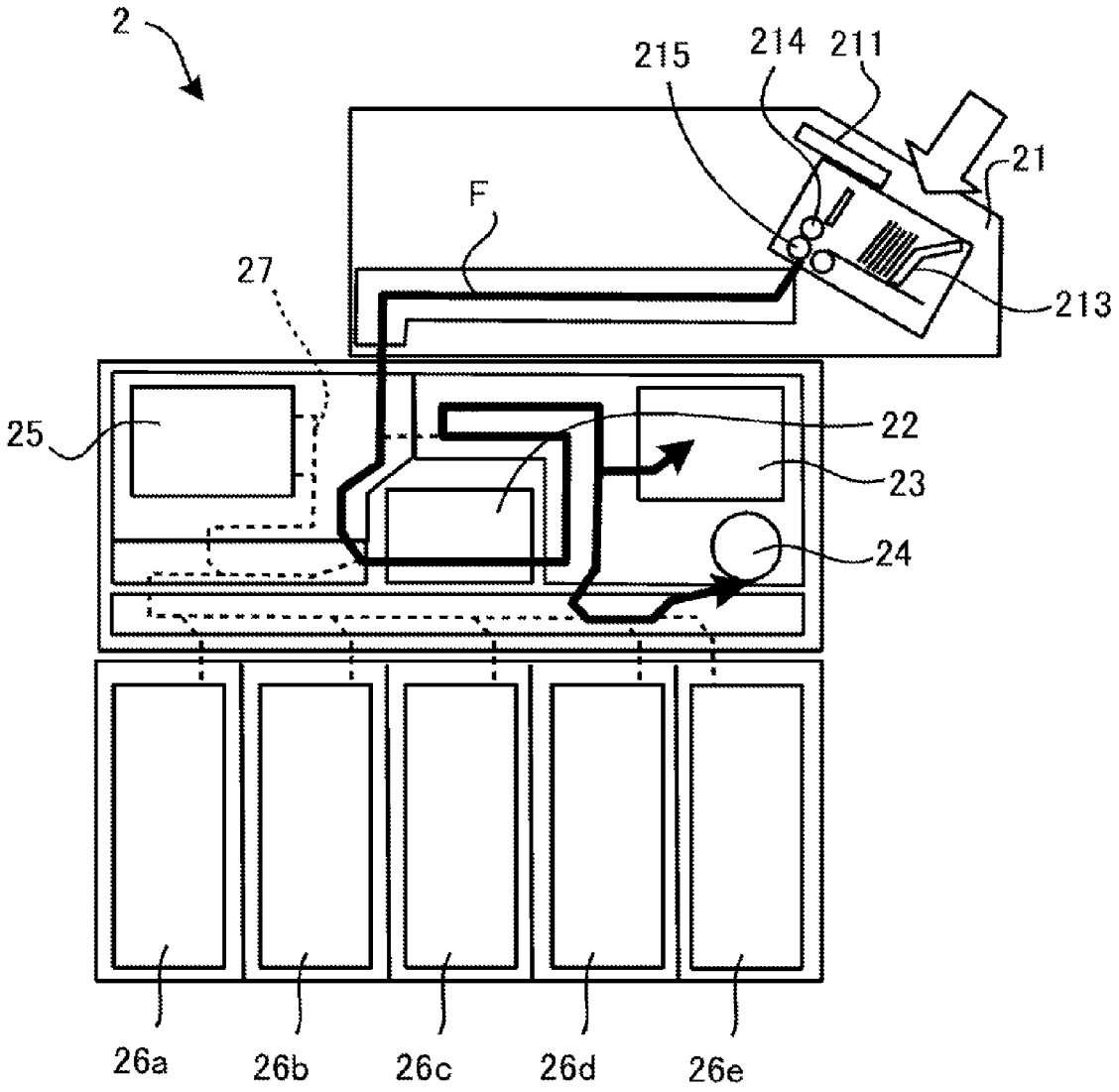
FIG. 3 is a diagram of the paper sheet handling apparatus, as seen from its side, for explaining counting operation of the paper sheet handling apparatus.

Next, the operation of the paper sheet handling apparatus 2 will be explained. The paper sheet handling apparatus 2 implements two-step operation, that is, operation to count the number of paper sheets at the time of a money deposit transaction and operation to convey the paper sheets to the storage containers in the safe. FIG. 3 explains the counting operation of the paper sheet handling apparatus 2. The paper sheet handling apparatus 2 opens a shutter 211 of the money deposit/withdrawal port 21 and forms a standby state for insertion of paper sheets into the money deposit/withdrawal port 21. Once the paper sheets are inserted into the money deposit/withdrawal port 21, the paper sheet handling apparatus 2 closes the shutter 211 and operates the pushing plate 213 to align the edges of the paper sheets together in the money deposit/withdrawal port 21. Subsequently, the paper sheet handling apparatus 2 rotates the separation roller 214 to separate the paper sheets one by one and makes the feed roller 215 send out the paper sheets in sequential order to the conveying path 27. Through the conveying path 27, the paper sheets are conveyed along the path represented by F by means of the conveyance rollers and the conveyance belts over the conveying path 27 and the paper sheets are stored in the temporary storage container 23 or the temporary return storage container 24. The discrimination device 22 exists in the middle of the conveying path 27 to count the number of the paper sheets, identify the types of the paper sheets, and judges the authenticity.

Figure 4:
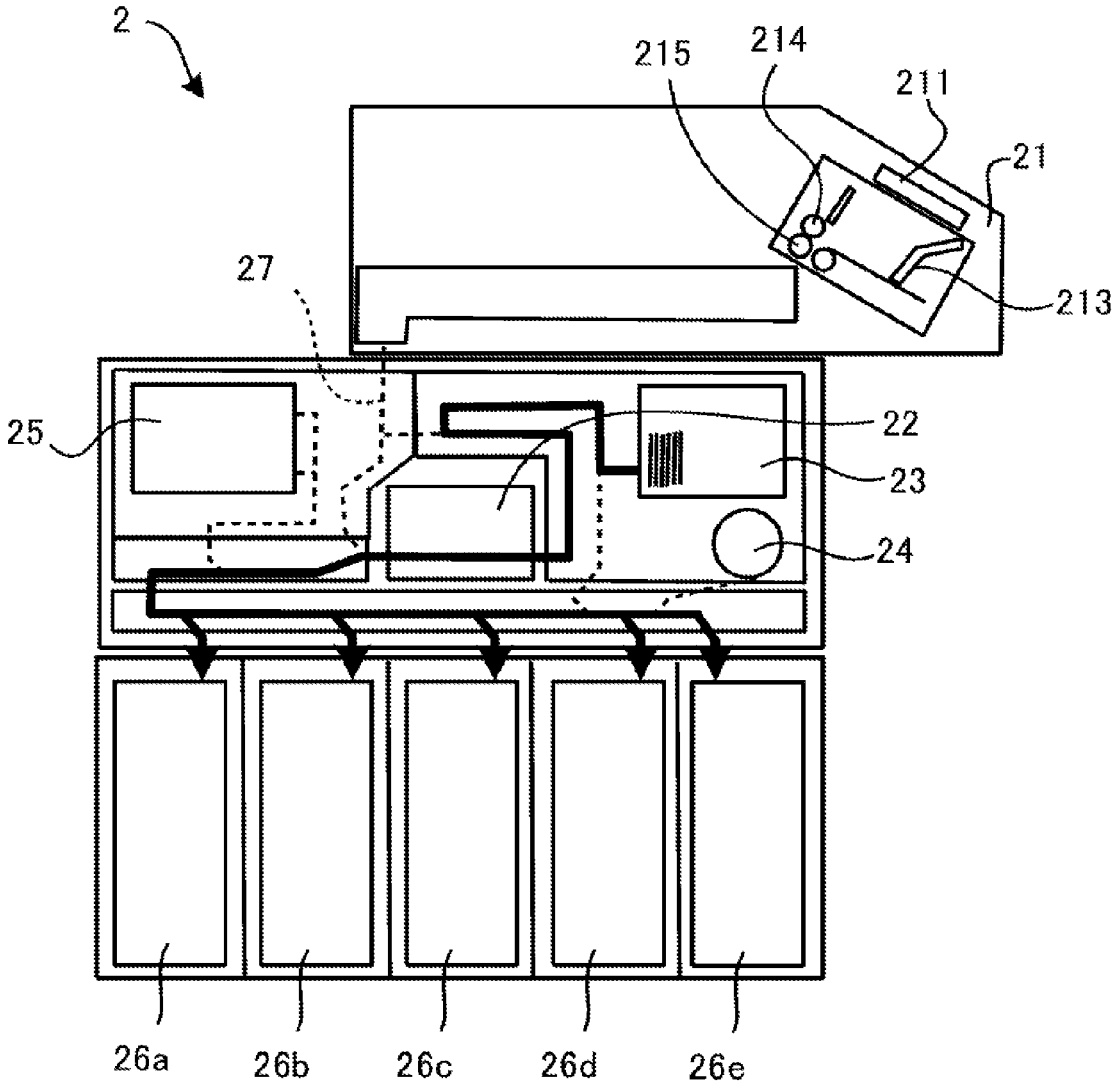
FIG. 4 is a diagram illustrating the internal configuration of the paper sheet handling apparatus, as seen from its side, for explaining storage operation of the paper sheet handling apparatus.

FIG. 4 is a diagram for explaining storage operation of the paper sheet handling apparatus 2. When a transaction is effected by confirming the amount of money inserted by the user, the temporary storage container 23 feeds the accumulated paper sheets one by one to the conveying path 27. The conveying path 27 allows the received paper sheets to pass through the discrimination device 22 again and conveys them to the storage containers 26*a* to 26*e*. The denominations and authenticity of the paper sheets are discriminated by the discrimination device 22 again and the paper sheets are sorted to the storage containers 26*a* to 26*e* on the basis of the denominations. When this happens, for example, one of the storage containers 26*a* to 26*e* can be applied as a dedicated storage container to collect paper sheets determined as counterfeit by the authenticity judgment.

Figure 5:
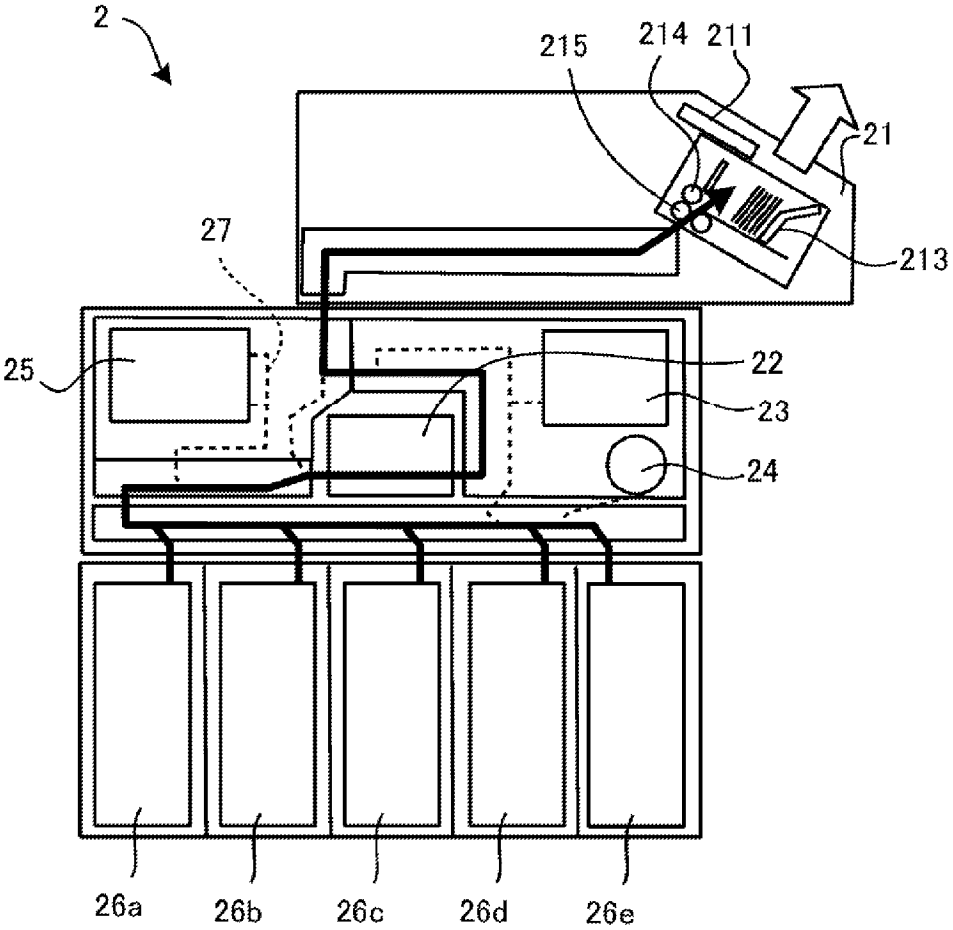
FIG. 5 is a diagram illustrating the internal configuration of the paper sheet handling apparatus, as seen from its side, for explaining money withdrawal operation of the paper sheet handling apparatus.

FIG. 5 shows withdrawal operation of the paper sheet handling apparatus 2. When a withdrawal transaction is effected by the user, the paper sheet handling apparatus 2 feeds the paper sheets accumulated in the storage containers 26*a* to 26*e* one by one to the conveying path 27 and conveys the paper sheets to the money deposit/withdrawal port 21. The paper sheet handling apparatus 2 has the feed roller 215 draw in the paper sheets from the conveying path 27 to the money deposit/withdrawal port 21, aligns the edges of the paper sheets and accumulates them, then opens the shutter 211, and makes the paper sheets exposed to the user.

Figure 6:
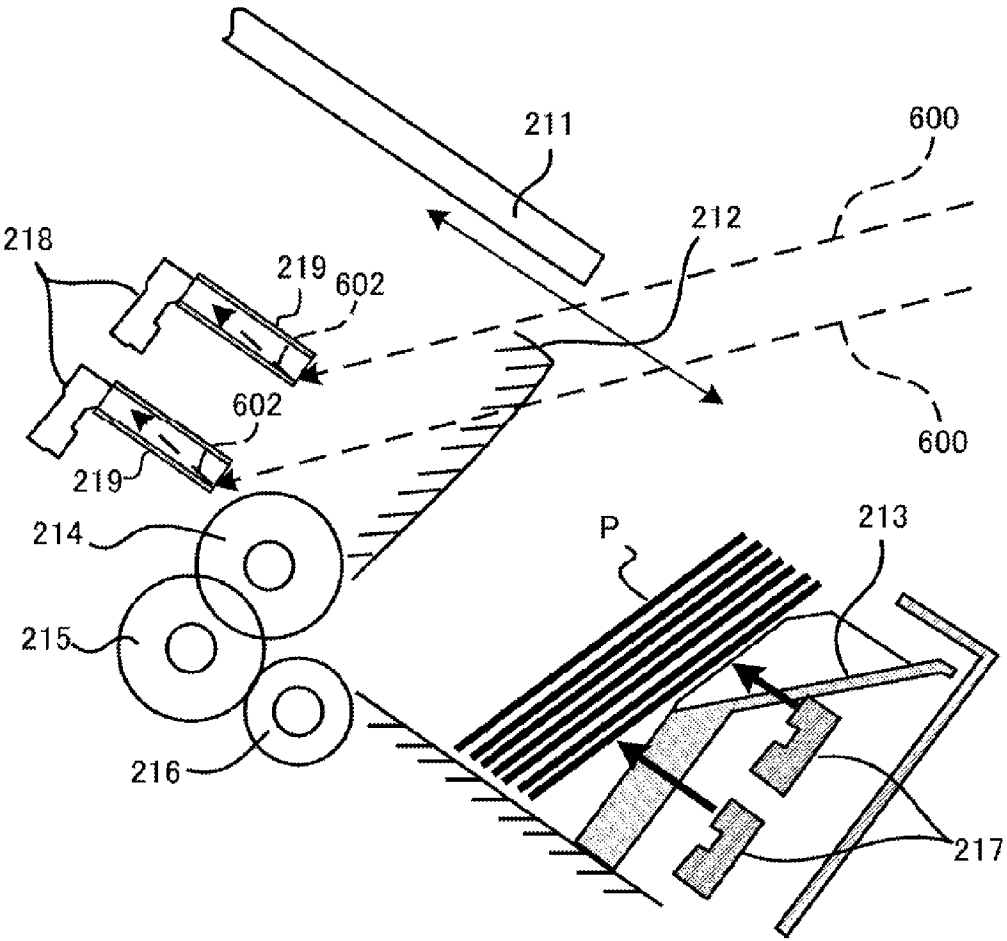
FIG. 6 is an enlarged view of a device configuration of a money deposit/withdrawal port of the paper sheet handling apparatus.

Referring to FIG. 6, the money deposit/withdrawal port 21 is provided with the shutter 211, a stack guide 212, the pushing plate 213, the separation roller 214, the feed roller 215, a sheet roller 216, a projector 217, a photodetector 218, and a light-shielding barrel 219. The light-shielding barrel 219 is used to protect the photodetector 218 against the external light (sunlight and/or illuminating light) as described later and prevents the photodetector 218 from malfunctioning due to the external light.

The shutter 211 is configured as a plate-like component and controls access to the money deposit/withdrawal port 21 by sliding in a direction opening or closing the recess. The stack guide 212 is a plate-like member which is inclined back and forth on its lower end as a fulcrum. The pushing plate 213 is a plate-like member which slides back and forth. The separation roller 214 includes a high-friction member such as rubber at part of its outside surface. The feed roller 215 is composed as a rubber roller. The sheet roller 216 is equipped with a plurality of blades, which are made of rubber or film-like members, on its surface. The blades are flexible and configured to bend even when they contact, for example, the stack guide 212, the pushing plate 213, and the bottom face.

Figure 8:
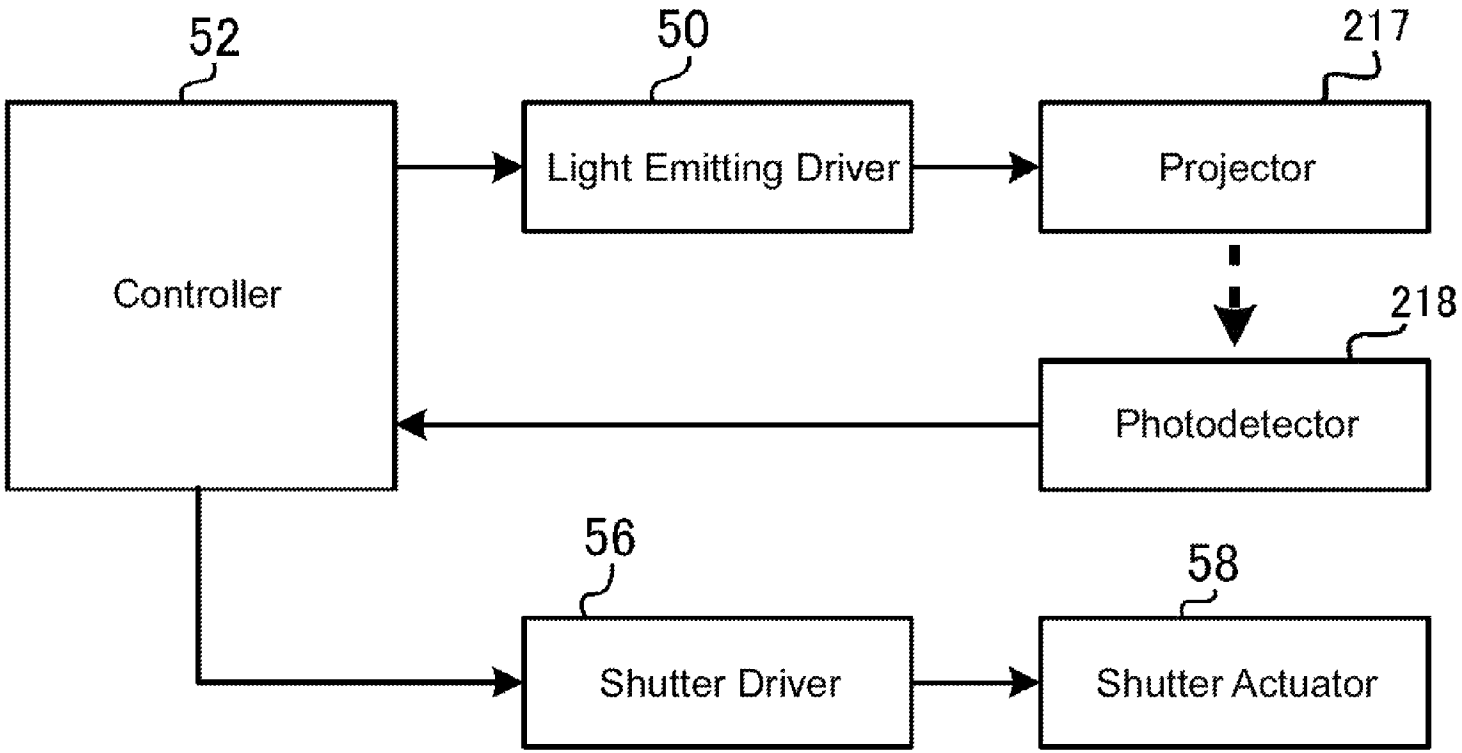
FIG. 8 is a control block diagram of a projector, the photodetector, and a shutter.

The projector 217 is configured so that an LED is integrated with a lens cap; and the projector 217 emits light linearly towards the photodetector 218 (light-receiving sensor). Referring to FIG. 8, the projector 217 is connected to a controller 52 via a light emitting driver 50. The controller 52 controls emission or no emission of the light from the LED of the projector 217 by controlling the light emitting driver 50. The photodetector 218 is configured so that a phototransistor is integrated with a lens cap; and when the photodetector 218 detects the light from the projector 217, it outputs a detection signal to the controller 52. The controller 52 forms a shutter driving control signal on the basis of the detection signal from the photodetector 218 and supplies it to a shutter driver 56. The shutter driver 56 controls a drive unit 58 (motor or solenoid) of the shutter, thereby implementing the operation to open or close the shutter 211.

Figure 7:
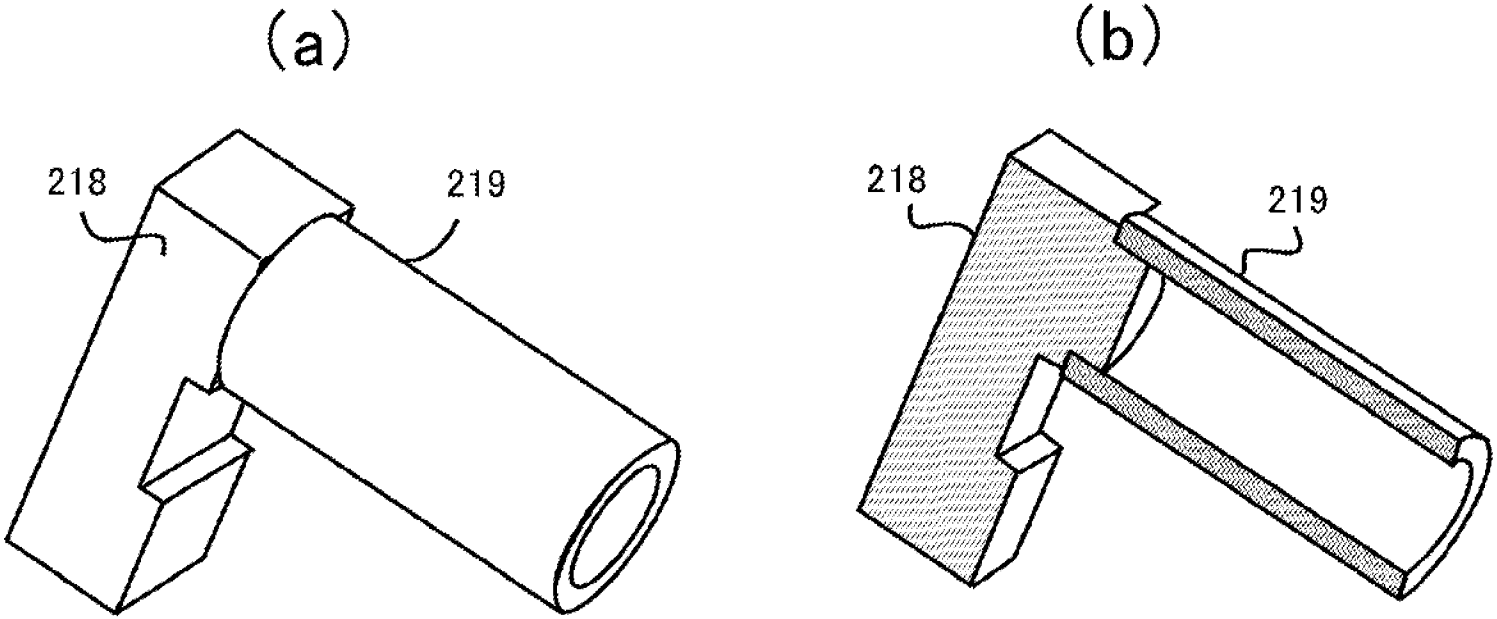
FIG. 7 is an enlarged perspective view of a connector composed of a light-shielding barrel and a photodetector.

FIG. 7 shows enlarged views of the light-shielding barrel 219 and the photodetector 218 in FIG. 6. FIG. 7(*a*) is a perspective view of a connected structure of the light-shielding barrel 219 and the photodetector 218 and FIG. 7(*b*) is a sectional view of such connected structure. The light-shielding barrel 219 is made of a hollow cylinder composed of a light-shielding material and extends along an optical path from the projector 217 to the photodetector 218 and its base end is secured to the projector-217-side end of the photodetector 218. The light output from the projector 217 travels through the light-shielding barrel 219 from the projector-217-side end of the light-shielding barrel 219 and reaches the photodetector 218 at the base end of the light-shielding barrel 219. The paper sheet handling apparatus 2 monitors the status inside the money deposit/withdrawal port 21 on the basis of detection of the light output from the projector 217 by the photodetector 218. When paper sheets P exist in the money deposit/withdrawal port 21 as illustrated in FIG. 6, the light output from the projector 217 cannot reach the photodetector 218 due to the paper sheets P. On the other hand, when the paper sheets P do not exist, the light output from the projector 217 travels through the light-shielding barrel 219 towards the photodetector 218 and is detected by the photodetector 218. Whether the user's fingers or palm exists in the money deposit/withdrawal port 21 or not is judged in the same manner as the paper sheets P. When the paper sheets or the fingers exist in the money deposit/withdrawal port 21, the photodetector 218 cannot detect the light output from the projector 217 and thereby keeps the shutter in an opened state.

The photodetector 218 is shielded by the light-shielding barrel 219 against the external light 600, but the money deposit/withdrawal port 21 is inclined towards the user on the front face as illustrated in FIG. 6. So, the external light 600 which has entered the money deposit/withdrawal port 21 may sometimes be reflected by the projector-217-side end of the light-shielding barrel 219, depending on a degree of its incident angle; and the reflected light 602 may repeat being reflected while travelling through the light-shielding barrel 219, and then reach the photodetector 218, causing the photodetector 218 to malfunction. Therefore, there is a possibility that the shutter may be closed although the paper sheets or the fingers exist in the money deposit/withdrawal port 21.

Figure 9:
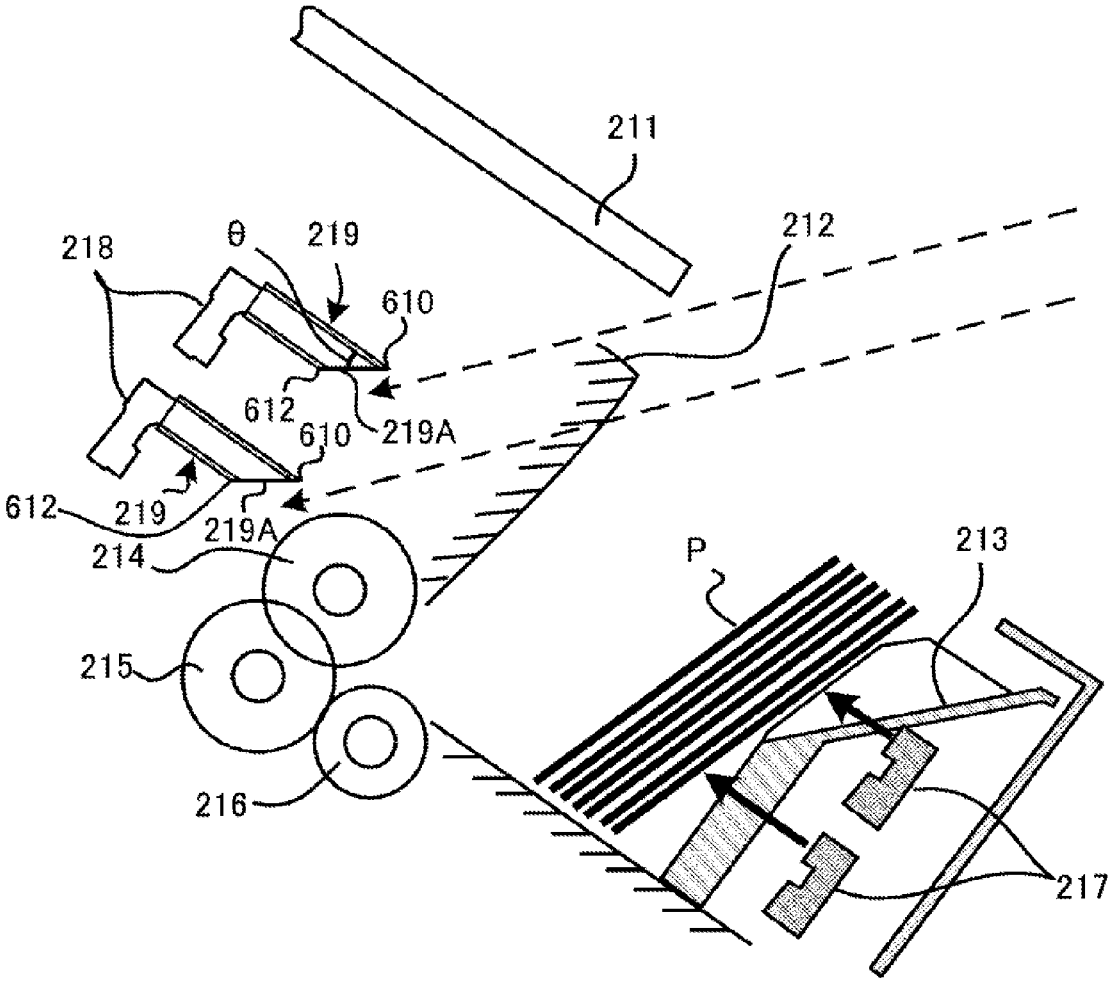
FIG. 9 is a diagram illustrating the configuration around the money deposit/withdrawal port according to a first embodiment.
Figure 10:
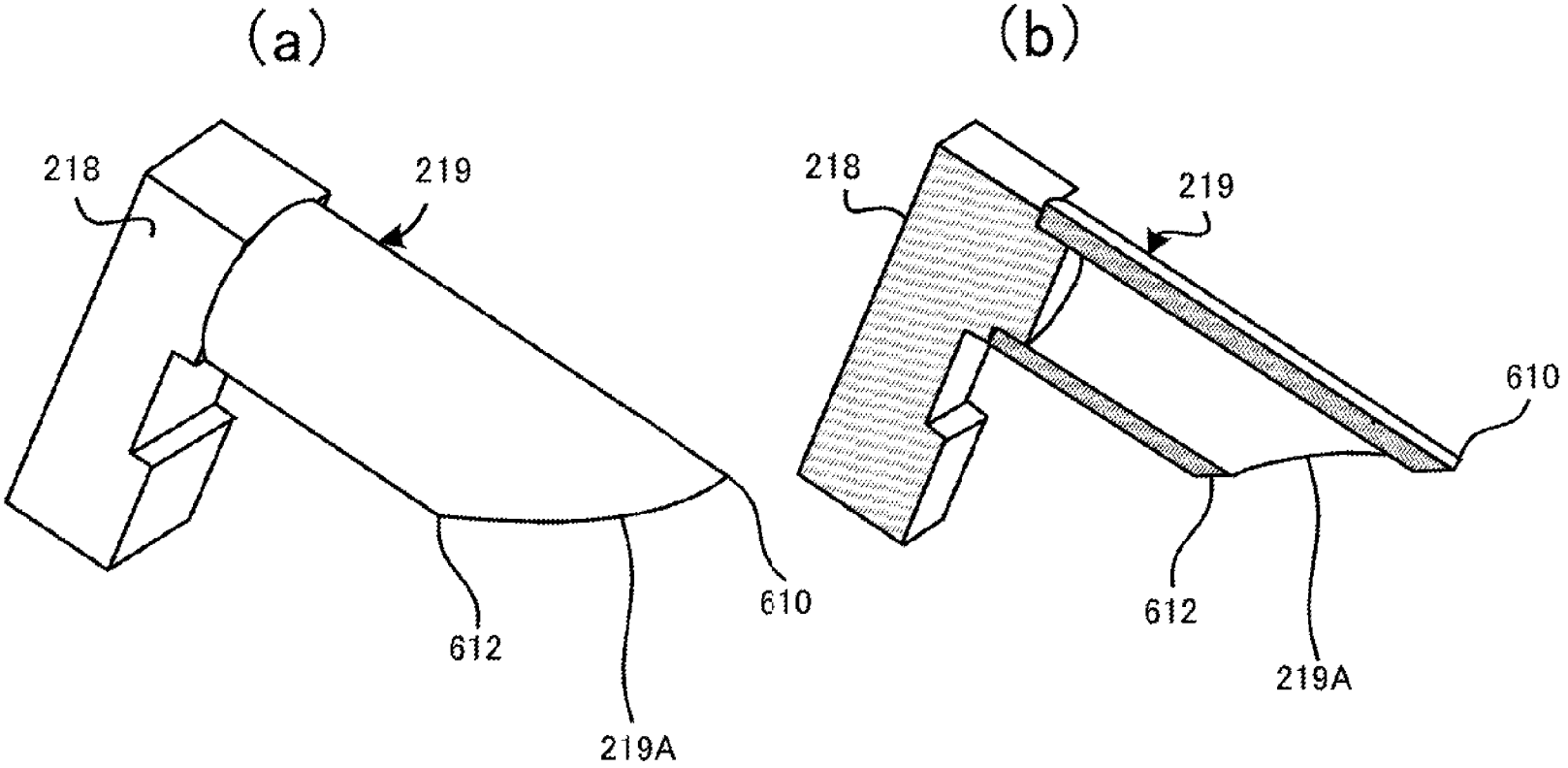
FIG. 10 is an enlarged perspective view of the connector and shows that a projector-side end of the light-shielding barrel is formed in a form preventing the external light from entering the light-shielding barrel.

So, the projector-217-side end of the light-shielding barrel 219 is formed in a form preventing the external light from entering the light-shielding barrel as illustrated in FIG. 9 and FIG. 10. Specifically speaking, the projector-217-side end of the light-shielding barrel 219 is retracted or offset from an incident direction 600 of the external light towards the photodetector 218, so that a front-end-side edge 612 in a radial direction of the light-shielding barrel 219 relative to the incident direction of the external light is retracted, further than a base-end-side edge 610 relative to the incident direction of the external light, towards the photodetector 218. In other words, for example, a tapered or substantially tapered open end 219A is formed at the projector-217-side end of the light-shielding barrel 219 and the open end 219A is set to face away from the travelling direction 600 of the external light, for example, to face a gravity direction or substantially gravity direction. Accordingly, the edge of the projector-217-side end of the light-shielding barrel 219 which can reflect the external light (see FIG. 6) can be hidden from the incident direction 600 of the external light, so that it is possible to prevent the external light from being reflected by the projector-217-side end of the light-shielding barrel 219 and travelling through the light-shielding barrel 219. An angle θ (FIG. 9) formed at the projector-217-side end of the light-shielding barrel 219 may be set to an appropriate angle, for example, an acute angle so that reflection of the external light can be prevented. More specifically, it is preferable that the angle θ should be a value smaller than an angle formed by the lengthwise direction of the light-shielding barrel 219 and the horizontal direction.

The light-shielding barrel 219 is formed by, for example, mixing black powder such as carbon black in polyacetal resin (POM) which is a light-shielding material. It is possible to further prevent the external light from transmitting through the light-shielding barrel 219 by changing a compounding ratio of components such as the carbon black or changing the thickness of the light-shielding barrel 219. Incidentally, a section of the light-shielding barrel 219 in its radial direction may be a polygon such as a triangle or a quadrangle other than the circle as described earlier. Furthermore, for example, a flange obtained by dividing the light-shielding barrel along its lengthwise direction may be used instead of the light-shielding barrel and connected to the photodetector 218 to protect the photodetector 218 against the external light. This structure can prevent paper powder or dust from being piled in the barrel as in the case of the light-shielding barrel.

Figure 11:
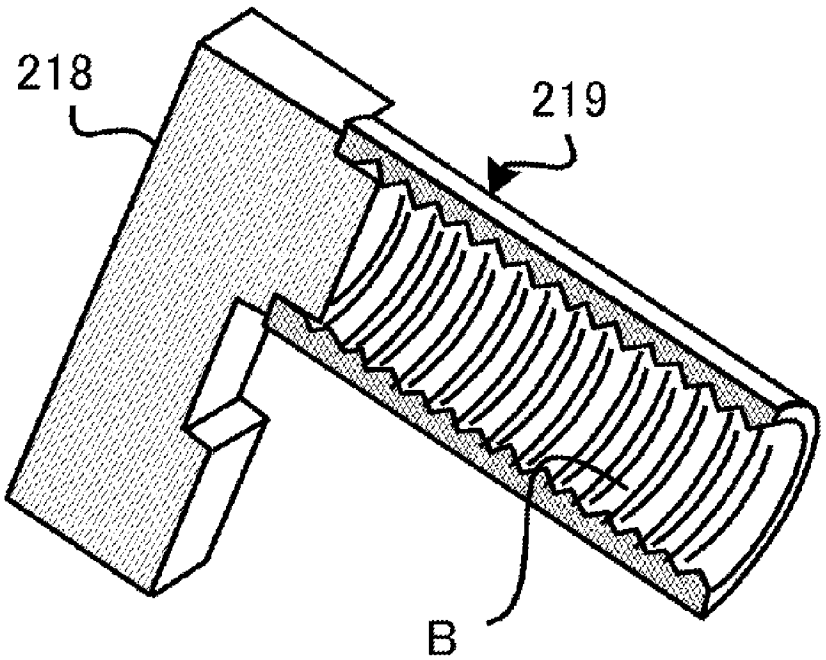
FIG. 11 is a perspective view of the light-shielding barrel which shows another form of the light-shielding barrel.
Figure 12:
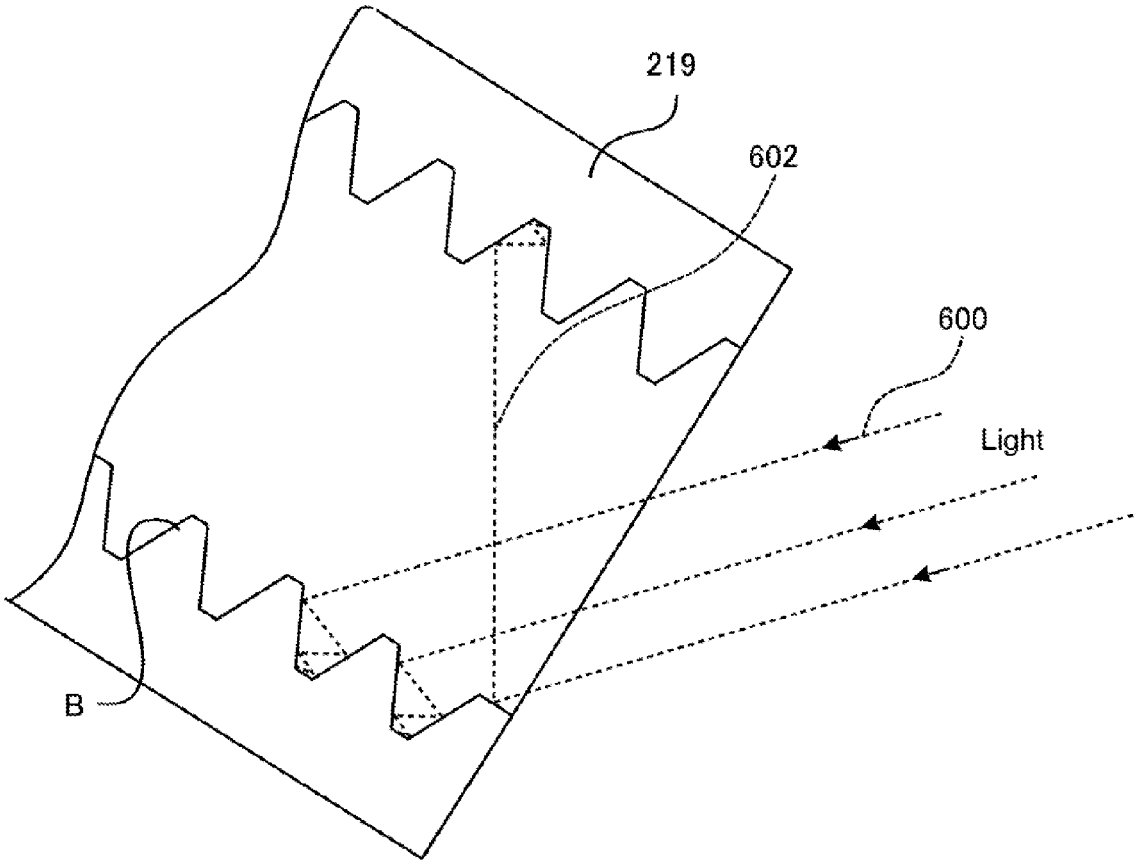
FIG. 12 is an enlarged view of grooves formed in an inside wall of the light-shielding barrel in FIG. 11.

FIG. 11 illustrates another example of the light-shielding barrel 219. Annular grooves B are formed in an inside wall (inside surface) of the light-shielding barrel 219. If the groove part B is formed with, for example, screw grooves, the light-shielding barrel 219 can be molded by resin molding or tapping. Another member with the grooves B may be inserted and set in the light-shielding barrel. FIG. 12 shows an enlarged view of the grooves B. The grooves B are, for example, triangular V-grooves and a larger difference between the top of threads and the base of the threads is preferred within a range not disturbing the optical path of the light emitted from the projector 217. Even when the external light 600 is reflected by the projector-217-side end of the light-shielding barrel 219 and the external light 600 enters the light-shielding barrel 219, the external light in the light-shielding barrel 219 is attenuated by being reflected by the grooves B in a direction away from the photodetector 218. If the annular grooves B are triangular, inclined faces of the grooves B on the incident side are hidden behind the grooves B themselves and cannot be seen from the photodetector 218, the external light repeats being reflected towards the depths of these inclined faces, so that the external light will be attenuated without reaching the photodetector 218. Even if the external light should reach the photodetector 218, it would be sufficiently attenuated and would not affect the photodetector 218 so much.

Figure 13:
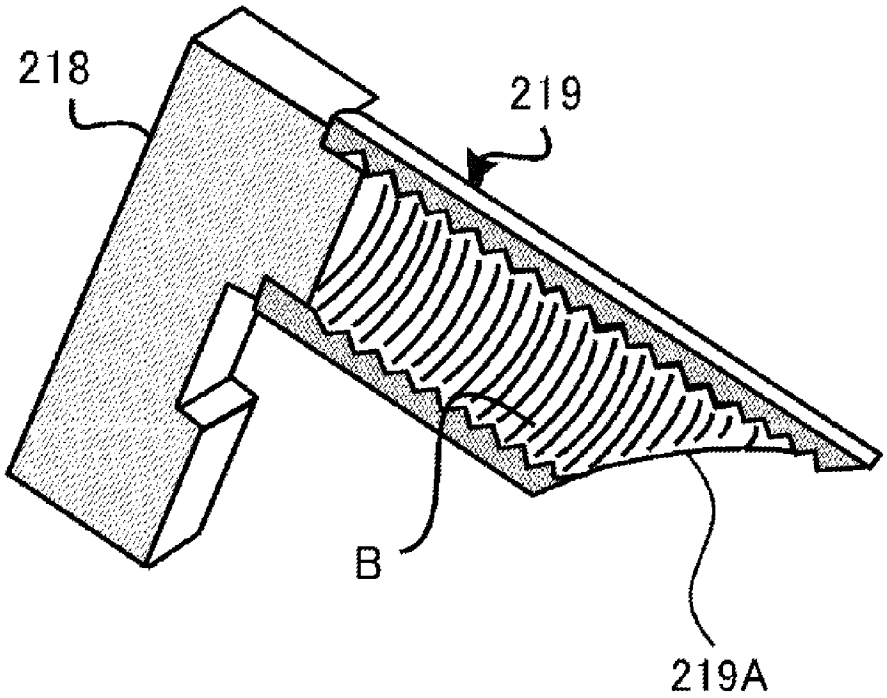
FIG. 13 is a perspective view of the light-shielding barrel which further shows another form of the light-shielding barrel.

FIG. 13 illustrates a further another form of the light-shielding barrel 219. The projector-217-side end of the light-shielding barrel 219 is configured to not intersect with the incident direction of the external light as described above and the aforementioned annular grooves B are formed inside the light-shielding barrel 219. Therefore, even when not direct light of the external light, but its reflected light enters the light-shielding barrel 219 through the projector-217-side end of the light-shielding barrel 219, this light-shielding barrel 219 can further prevent the external light from reaching the photodetector 218.

Figure 14:
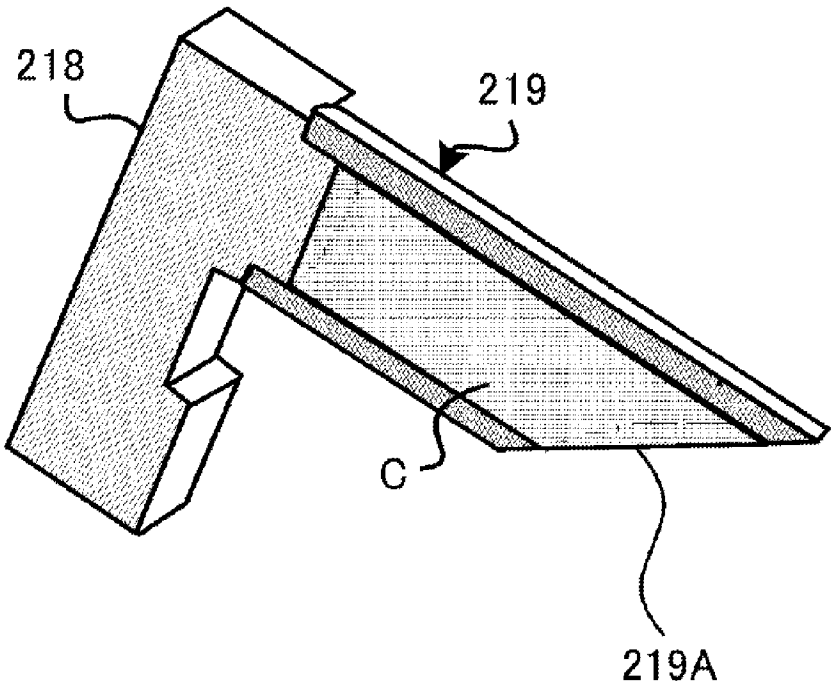
FIG. 14 is a perspective view of the light-shielding barrel which further shows another form of the light-shielding barrel.

FIG. 14 illustrates a further another form of the light-shielding barrel 219. The light-shielding barrel 219 is filled with a translucent member C. The translucent member C is formed by injection molding of, for example, acrylic resin or polycarbonate resin which can transmit the light output from the projector 217. The light-shielding barrel 219 is obtained by molding resin which has a light-shielding property, or by covering a molded body of light-projecting resin with a light-shielding material such as a metal film. It is possible to prevent paper powder, dust, and so on from being piled in the light-shielding barrel by making the inside of the light-shielding barrel 219 filled. Attenuation of the external light by the annular grooves B can be implemented by forming the aforementioned annular grooves B around the outside surface of the transparent member C and coating its outside surface with the light-shielding material such as a metal film.

Furthermore, the angle θ (FIG. 9) of the projector-217-side end of the light-shielding barrel 219 can be mitigated towards a more obtuse angle than the angle θ in FIG. 9 and the entire length of the light-shielding barrel 219 can be shortened by setting the angle θ in consideration of air and a critical angle of the translucent member C so that a full surface reflection will be implemented at an incident angle of the external light and the light can be entered from the projector 217.

Figure 15:
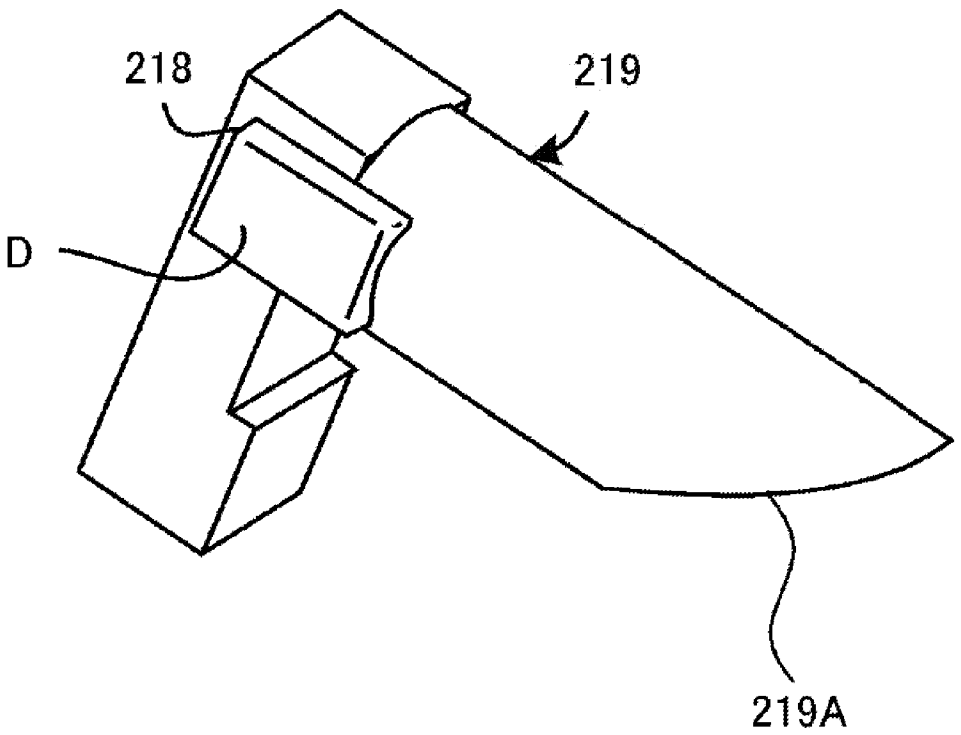
FIG. 15 is a perspective view of the light-shielding barrel which further shows another form of the light-shielding barrel.

FIG. 15 illustrates a further another form of the light-shielding barrel 219. The light-shielding barrel 219 has a flange D on a side face of its photodetector-218-side end. As this flange D is configured to enable positioning and attachment on a side face of the photodetector 218, the light-shielding barrel 219 can be connected to the photodetector 218 so that the projector-217-side front end 219A of the light-shielding barrel 219 will be set in a gravity direction. For example, a hook may be formed at part of the flange D so that the hook can be fixed at a specified position of a side wall of the photodetector 218.

Figure 16:
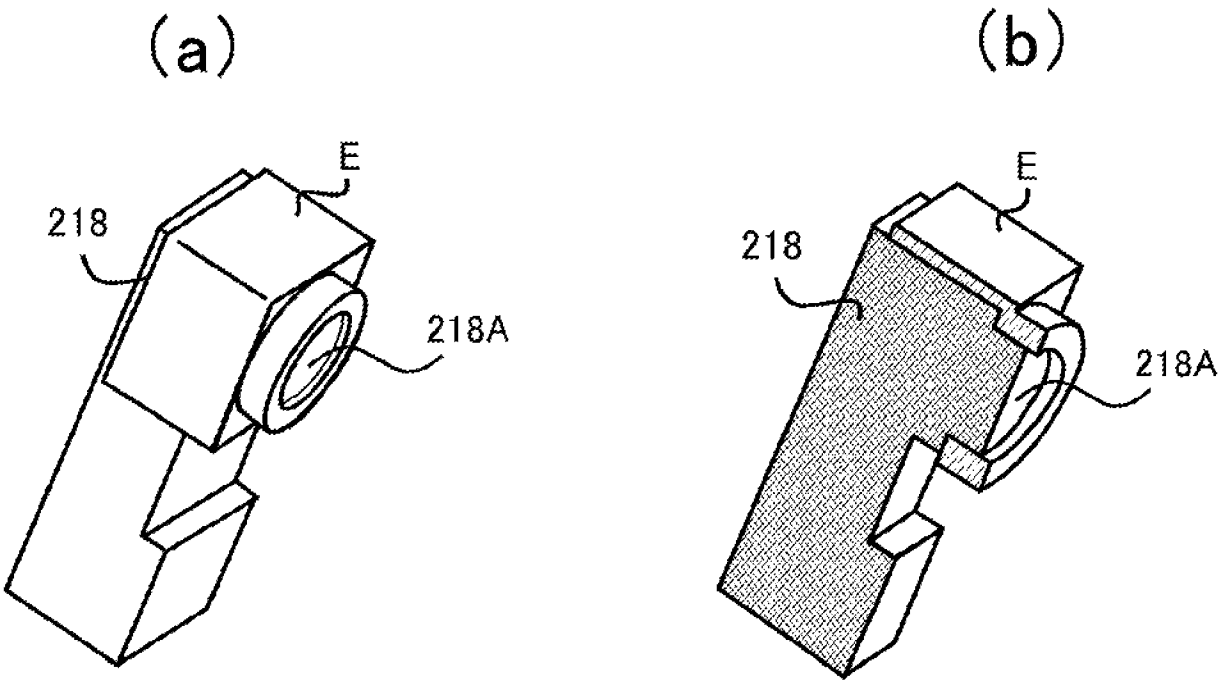
FIG. 16 is a perspective view of the light-shielding barrel which further shows another form of the light-shielding barrel.

FIG. 16 illustrates another form of the photodetector 218. A light-shielding member E is added around the light-receiving part 218A of the photodetector 218. The light-shielding member E covers the side face of the photodetector 218 and is formed of the same material as that of the light-shielding barrel 219. The side face of the photodetector

218 is molded integrally with a lens of the light-receiving part 218A. Thus, when the external light reaches the side face of the photodetector 218, the external light may sometimes pass through the side face of the photodetector 218 and cause the light-receiving part 218A to malfunction. Therefore, the light-receiving part 218A can be protected against the external light by providing the light-shielding member E to cover the side face of the light-receiving part 218A of the photodetector 218.

REFERENCE SIGNS LIST

217 projector, 218 photodetector, 219 light-shielding barrel, 219A tapered face

The invention claimed is:

1. A paper sheet handling apparatus comprising:

a paper sheet handling port;

a shutter arranged to open and close the paper sheet handing port;

a projector for emitting light within the paper sheet handling port;

a photodetector for receiving the light emitted from the projector;

a light-shielding body that is formed along an optical path from the projector towards the photodetector and shields the photodetector against external light; and a controller configured to open or close the shutter based on receiving a detection signal from the photodetector, wherein a projector-side end of the light-shielding body is formed to be retracted from an incident direction of the external light towards the photodetector.

2. The paper sheet handling apparatus according to claim 1, wherein a front-end-side edge of the projector-side end relative to a travelling direction of the external light is further retracted than a base-end side of the projector-side end relative to a travelling direction of the external light.

3. The paper sheet handling apparatus according to claim 1, wherein the projector-side end has a tapered face towards a substantially gravity direction.

4. The paper sheet handling apparatus according to claim 1, wherein an angle of the projector-side end is smaller than an angled formed between the light-shielding body and a horizontal direction.

5. The paper sheet handling apparatus according to claim 1, wherein grooves for reflecting the external light are formed in an inside surface of the light-shielding body.

6. The paper sheet handling apparatus according to claim 1, wherein the light-shielding body is filled with a translucent member.

7. The paper sheet handling apparatus according to claim 1, wherein a side face of the photodetector is covered with a light-shielding member.

8. The paper sheet handling apparatus according to claim 5, wherein a side face of the photodetector is covered with a light-shielding member.

9. A paper sheet handling apparatus comprising:

a paper sheet handling port;

a shutter arranged to open and close the paper sheet handing port;

a projector for emitting light within the paper sheet handling port;

a photodetector for receiving the light emitted from the projector;

a light-shielding body that is formed along an optical path from the projector towards the photodetector and shields the photodetector against external light; and a controller configured to open or close the shutter based on receiving a detection signal from the photodetector, wherein grooves for reflecting the external light are formed in an inside surface of the light-shielding body.

10. The paper sheet handling apparatus according to claim 9, wherein a side face of the photodetector is covered with a light-shielding member.

11. A paper sheet handling apparatus comprising:

a paper sheet handling port;

a shutter arranged to open and close the paper sheet handing port;

a projector for emitting light within the paper sheet handling port;

a photodetector for receiving the light emitted from the projector;

a light-shielding body that is formed along an optical path from the projector towards the photodetector and shields the photodetector against external light; and a controller configured to open or close the shutter based on receiving a detection signal from the photodetector, wherein a side face of the photodetector is covered with a light-shielding member.

* * * * *